US006210114B1

(12) United States Patent
Kim

(10) Patent No.: US 6,210,114 B1
(45) Date of Patent: Apr. 3, 2001

(54) CROSS FLOW FAN FOR AIR CONDITIONER

(75) Inventor: Jae-Won Kim, Seoul (KR)

(73) Assignee: SeonMun University (KR); a part interest ( * ) Notice: Subject to any disclaimer, the term of this patent is extended or adjusted under 35 U.S.C. 154(b) by 0 days.

(21) Appl. No.: 09/263,339

(22) Filed: Mar. 5, 1999

(51) Int. Cl.[7] ..... B63H 1/26
(52) U.S. Cl. ..... 416/178; 416/214 R; 416/219 R
(58) Field of Search ..... 416/178, 214 R, 416/219 R, 244 R

(56) References Cited

U.S. PATENT DOCUMENTS 4,007,999 * 2/1977 Serizawa ..... 416/178
4,364,712 12/1982 Charles ..... 416/183

* cited by examiner

*Primary Examiner*—Edward K. Look
*Assistant Examiner*—Hermes Rodriguez
(74) *Attorney, Agent, or Firm*—Rosenthal & Osha L.L.P.

(57) ABSTRACT

A cross flow fan for an air conditioner constructed to allow a plurality of horizontally and sequentially arranged blades to be partitioned, each distanced by a predetermined space, by a plurality of vertically arranged diaphragms, wherein the cross flow fan comprises a through hole so formed as to have a diameter of 0.4~0.8D against a diameter D of the diaphragm, such that fluid infused into the fan can form an eddy current, such that amount of wind from the fan is increased to improve an energy consumption efficiency.

17 Claims, 7 Drawing Sheets

CROSS FLOW FAN FOR AIR CONDITIONER

BACKGROUND OF THE INVENTION

1. Field of the Invention

The present invention relates to a fan, and more particularly to a cross flow fan for an air conditioner.

2. Description of the Prior Art

Generally, an indoor unit in a separable air conditioner is constructed to occupy as small a space as possible and to generate as much wind as possible and the indoor unit is generally disposed with a horizontally formed cross flow fan.

The cross flow fan is disposed, as illustrated in FIG. 7, with a plurality of horizontal blades 51 mounted on a plurality of diaphragms 50, each arranged at a predetermined interval, and a rotary axle 52 piercing the plurality of diaphragms 50 and protruding at both ends of the diaphragms 50.

In other words, as illustrated in FIG. 8 blades 51, each having a predetermined length, are coupled to the diaphragms 50 where coupling holes 53 are sequentially arranged to insert the blades thereinto, to form a partitioning fan 54 and to stack the partitioning fans 54 by way of ultrasonic fusion for formation of a cross flow fan.

The purpose of partially forming the cross flow fan by way of the plurality of diaphragms 50 is to prevent deflection or deformation of the blades 51 as the blades 51 are made of relatively thin material.

SUMMARY OF THE INVENTION

However, there is a problem in the cross flow fan thus constructed in that fluid flowing in the fan is curtailed in flowing freely and energy efficiency is reduced due to weight increased by the cross flow fan having a plurality of diaphragms when the plurality of diaphragms are mounted to form a plurality of partitioned fans when the cross flow fan is manufactured.

There is another problem in that amount of wind output from the fans is reduced when the fluid is impeded in flowing freely.

The present invention is disclosed to solve the aforementioned problems and it is an object of the present invention to provide a cross flow fan for an air conditioner adapted to increase a free flow of fluid flowing in the fan, thereby increasing an amount of wind from the fan and improving an energy consumption efficiency.

In accordance with the object of the present invention, there is provided a cross flow fan for an air conditioner constructed to allow a plurality of horizontally and sequentially arranged blades to be partitioned, each distanced by a predetermined space, by a plurality of vertically arranged diaphragms, wherein the cross flow fan comprises a through hole so formed as to have a diameter of 0.4~0.8D against a diameter D of the diaphragm, such that fluid infused into the fan can form an eddy current.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
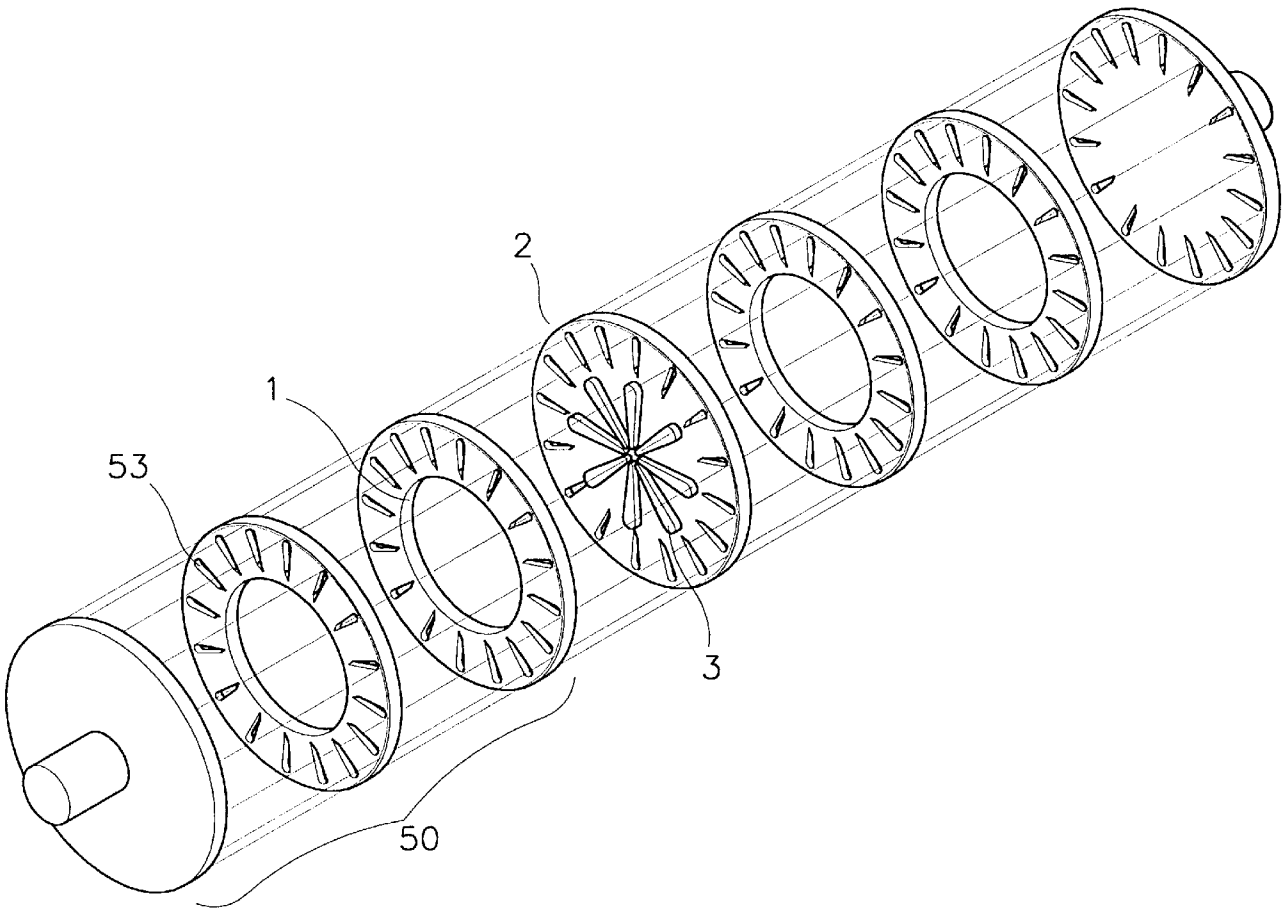
FIG. 1 is a perspective view for illustrating a diaphragm arrangement status of a cross flow fan for an air conditioner according to the present invention.
Figure 2:
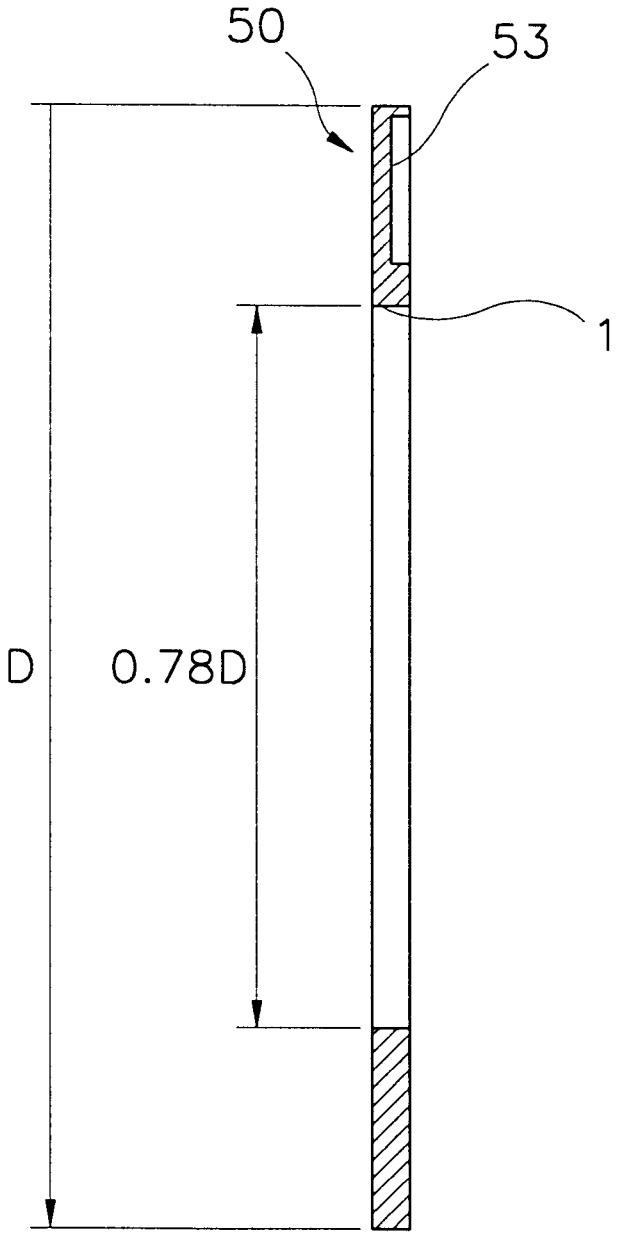
FIG. 2 is a side sectional view of a diaphragm in FIG. 1.
Figure 3:
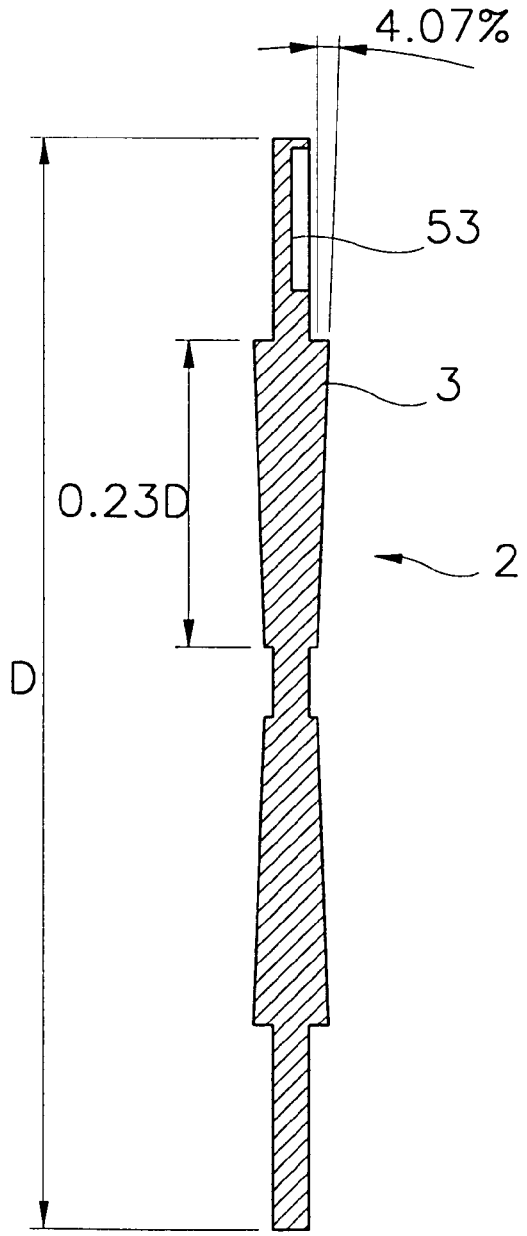
FIG. 3 is a side sectional view of a central diaphragm in FIG. 1.

As illustrated in FIGS. 1, 2 and 3, the diaphragm 50 is formed with a through hole 1 having a diameter of 0.78D against a diameter (D) of the diaphragm 50 for easy flow of the fluid. The reason of limiting the diameter of the through hole 1 at 0.78D is that, as illustrated in FIG. 4, eddy current is maximally generated when strength at a place where a blade 51 is coupled is optimally maintained.

Figure 4:
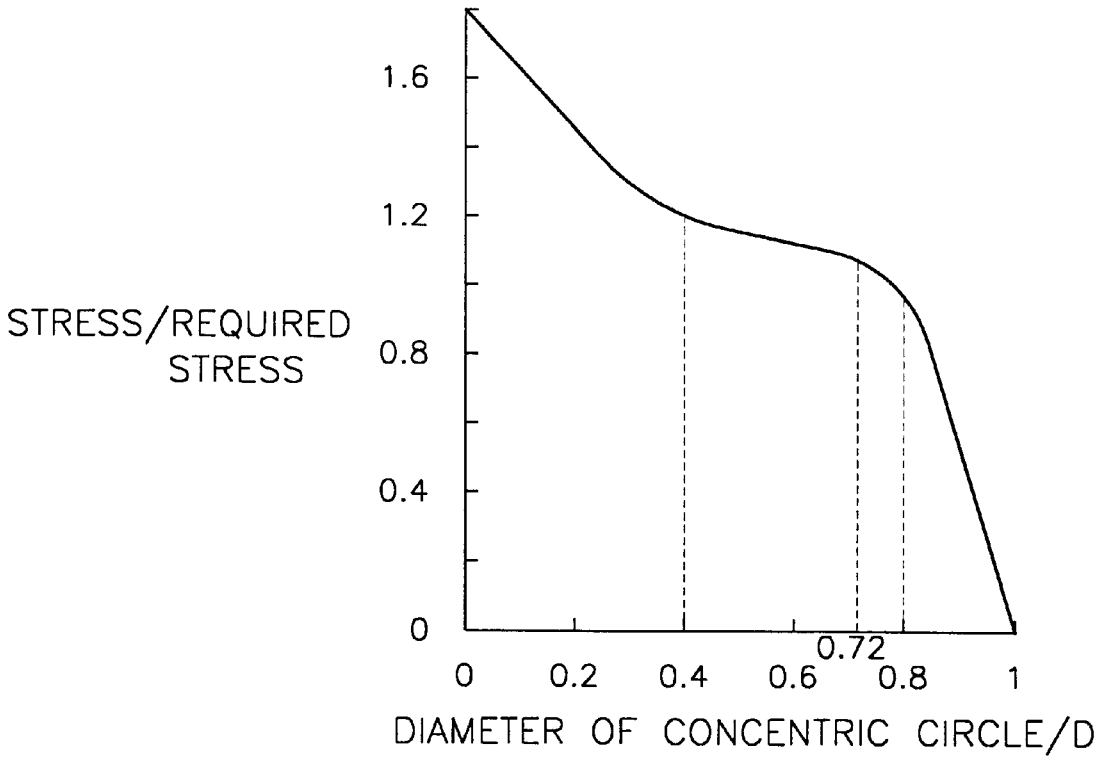
FIG. 4 is a graph for illustrating a stress and a required stress change according to diameter of a through hole formed at a diaphragm in FIG. 1.
Figure 5:
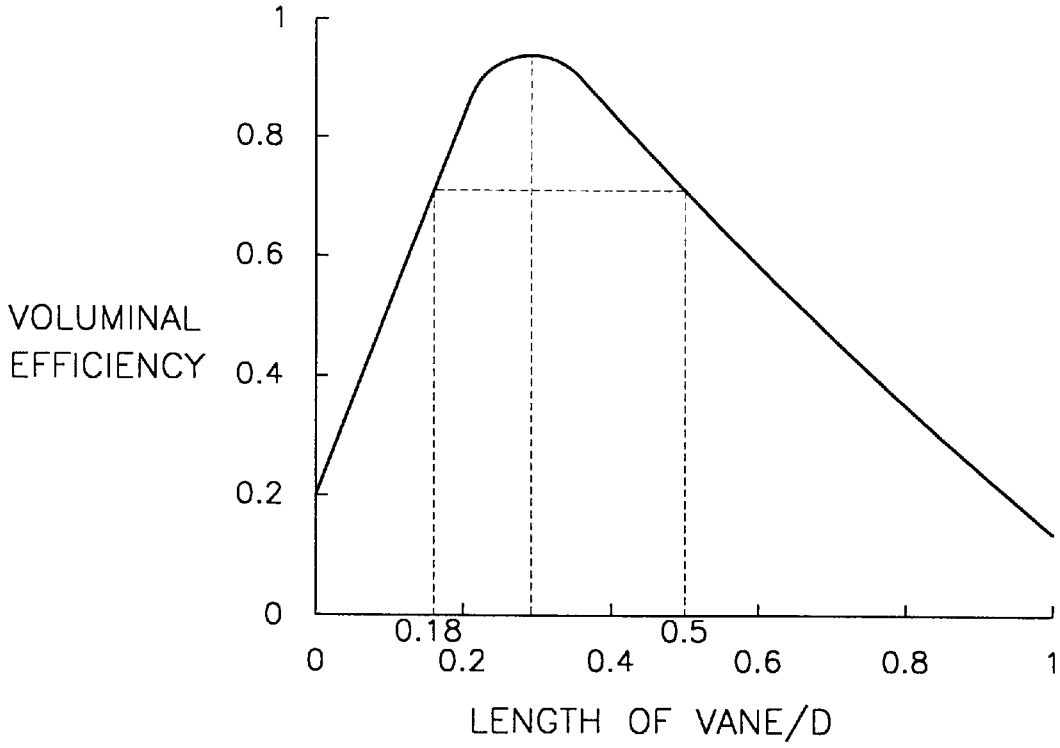
FIG. 5 is a graph for illustrating a volume efficiency change according to length of guide vane formed at a central diaphragm in FIG. 1.

In FIG. 4, the vertical axis represents a stress ratio on the diaphragm 50 against a stress required for strength guarantee and the longitudinal axis defines a ratio between the diameter of the through hole 1 and the diameter D of the diaphragm 50, where it should be noted that the same effect may be of attained if the ratio between the diameter of the through hole 1 and the diameter of the diaphragm 50 is 0.4—0.8D.

Particularly, the diaphragm 50 is centrally formed with a central diaphragm 2 for improving a fluid volume efficiency in a fan. The central diaphragm 2 is formed to increase a volume efficiency as the eddy current is increased in its formation in the fan. In other words, the central diaphragm 2 is disposed at radial lines with guide vanes 3, and length of each guide vanes 3 is formed at 0.23D, where D is a diameter of the central diaphragm 2. The eddy current is increased in amount thereof by blowing action or eddy current forming action of the guide vanes 3 from center of the fan to both sides thereof.

Furthermore, a sectional area of the guide vane 3 has a shape of an air foil, such that, when a fan is rotated, eddy current is maximally formed by the guide vanes 3 but frictional loss is minimized. The guide vane 3 is formed to have a gradually increasing incline of approximately 4.07% as they go from the center of the central diaphragm to periphery thereof. Although the guide vane 3 produces an optimal efficiency at a length of 0.23D, it can obtain a good voluminal efficiency at a range of 180~0.5D.

In other words, if the length of the guide vane 3 is within a range of 0.2~0.5D, the voluminal efficiency can be maintained at a good level.

Now, operational efficiency of the cross flow fan according to the present invention will be described.

When a power is applied to an air conditioner, the cross flow fan is rotated to suck the room air. The sucked room air flows in the fan through the through hole 1 formed at the diaphragm to generate an eddy current, where fluid sucked into the fan forms stronger eddy current according to the guide vanes 3 formed at the central diaphragm 2.

Figure 6:
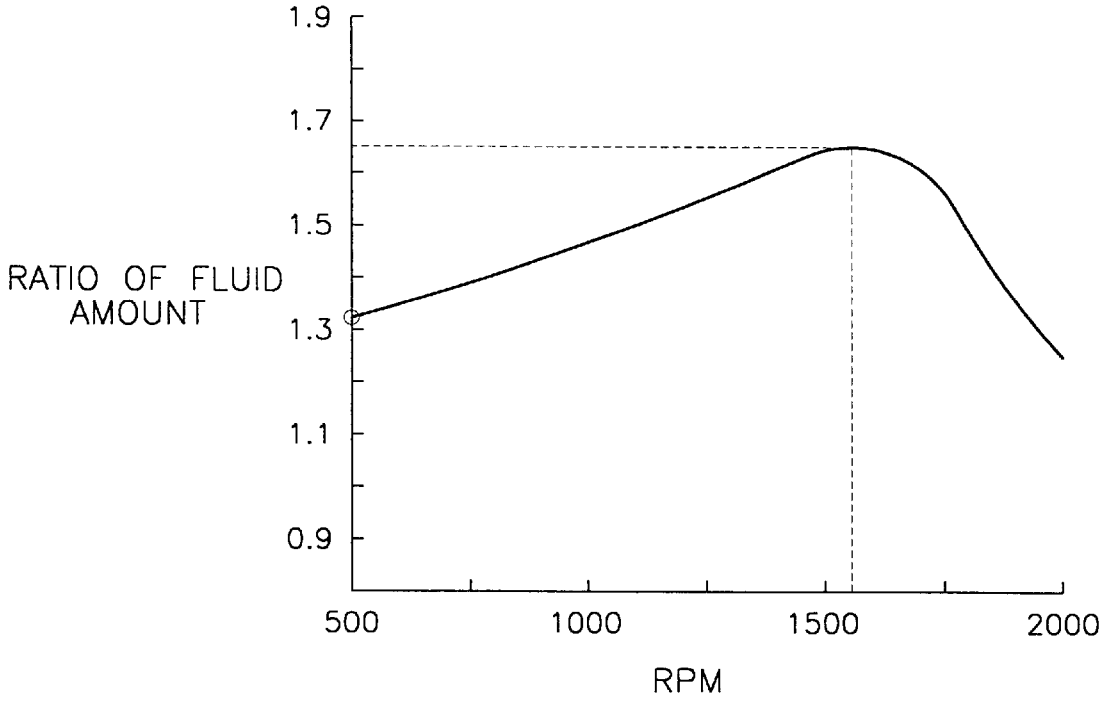
FIG. 6 is a graph for illustrating a fluid amount ratio between rpm of a cross flow fan according to the present invention and a cross flow fan according to the prior art.
Figure 7:
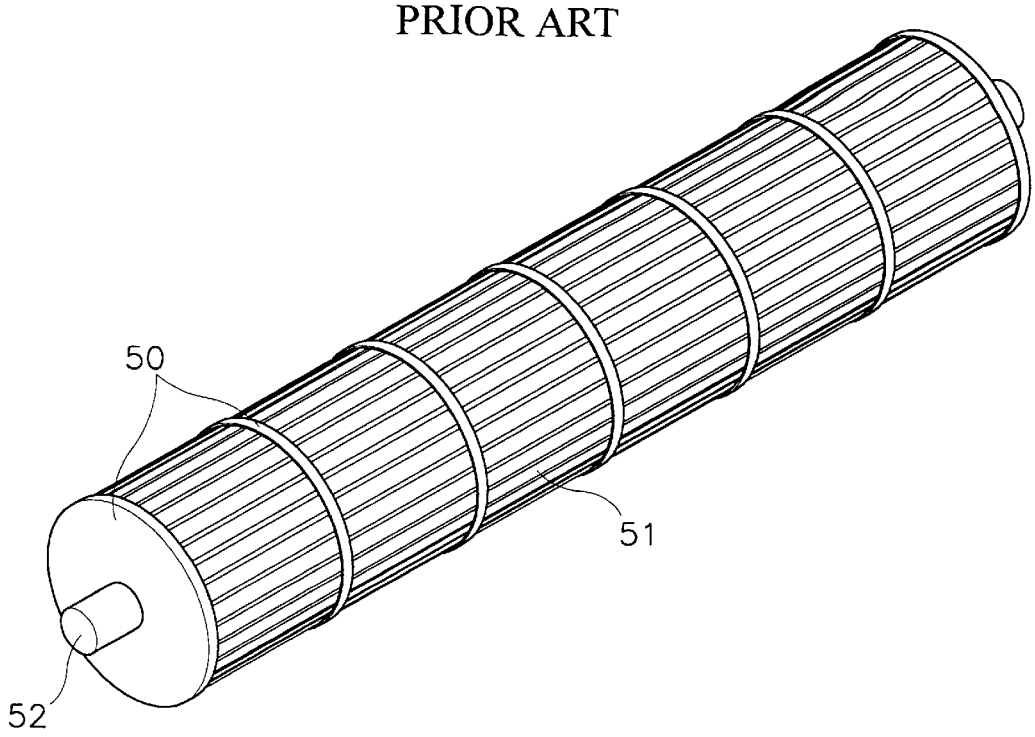
FIG.7 PRIOR ART
FIG. 7 is a perspective view for illustrating a cross flow fan for an air conditioner according to the prior art.
Figure 8:
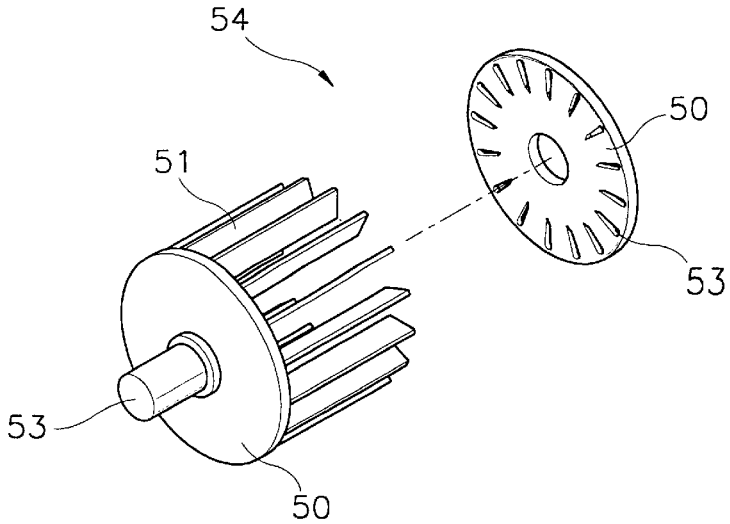
FIG.8 PRIOR ART
FIG. 8 is an exploded perspective view of a diaphragm.

In other words, the guide vanes 3 make the fluid in the fan a horizontal eddy current to thereby increase a voluminal efficiency of the fluid sucked into the fan. The ratio of fluid amount is improved by approximately 165% compared with a conventional fan when a rated revolution is given at 1,600 rpm, as illustrated in FIG. 6. Of course, even if the revolution is dropped to 500 rpm, amount of fluid is improved by approximately 130% compared with the conventional fan, such that it can be noted that amount of wind blown by the cross flow fan according to the present invention has been markedly increased.

Particularly, in case the same amount of blown wind is maintained as that of the conventional fan, it is all right to have a low rpm of the cross flow fan according to the present invention, such that a starting power is reduced by approximately 19% at a predetermined amount of wind output.

Furthermore, because the central diaphragm 2 is formed with guide vanes 3, not with through hole 1, it is heavier than other diaphragm 50, such that it functions as a fly wheel when the cross flow fan is rotated to further stabilize a rated rotation of the cross flow fan.

As apparent from the foregoing, there is an advantage in the cross flow fan according to the present invention in that the diaphragm of the cross flow fan is formed with a through hole of 0.78D and a central diaphragm having guide vanes, each having a diameter of 0.23D, such that amount of blown wind from the cross flow fan is increased to thereby reduce a starting power.

What is claimed is:

1. A cross flow fan for an air conditioner, comprising:

a plurality of vertically arranged diaphragms axially spaced apart each diaphragm having a through hole with a diameter of about 40 to 80 percent of a diameter of the diaphragm, whereby a fluid infused into the fan will form an eddy current;

a plurality of horizontally arranged blades mounted between the diaphragms; and a central diaphragm vertically disposed in the center of the fan, the central diaphragm including guide vanes radially disposed about a center of the central diaphragm, each guide vane having a length of about 18 to 50 percent of a diameter of the central diaphragm, wherein the guide vanes forcibly form the eddy current in the fan.

2. The cross flow fan as defined in claim 1 wherein the diameter of the through hole is about 78% of the diameter of the diaphragm.

3. The cross flow fan as defined in claim 1 wherein the length of each guide vane is 23 percent of the diameter of the central diaphragm.

4. The cross flow fan as defined in claim 1 wherein each guide vane is shaped as an airfoil.

5. The cross flow fan as defined in claim 1 wherein each guide vane has an incline of about 4.07 percent inclined radially outwardly with respect to a plane of the diaphragm.

6. The cross flow fan as defined in claim 4 wherein each guide vane has an incline of about 4.07 percent inclined radially outwardly with respect to a plane of the diaphragm.

7. A cross flow fan for an air conditioner, comprising:

a plurality of horizontally arranged blades mounted between a plurality of vertically arranged and axially spaced diaphragms; and a central diaphragm vertically disposed in the center of the fan, the central diaphragm including a plurality of guide vanes radially disposed about a center of the central diaphragm, each guide vane having a length of about 18 to 50 percent of a diameter of the central diaphragm, wherein the guide vanes forcibly form an eddy current in the fan.

8. The cross flow fan as defined in claim 7 wherein the length of each guide vane is 23 percent of the diameter of the central diaphragm.

9. The cross flow fan as defined in claim 7 wherein each guide vane is shaped as an air foil.

10. The cross flow fan as defined in claim 7 wherein each guide vane has an incline of about 4.07 percent inclined radially outwardly with respect to a plane of the diaphragm.

11. The cross flow fan as defined in claim 9 wherein each guide vane has an incline of about 4.07 percent inclined radially outwardly with respect to a plane of the diaphragm.

12. A cross flow fan for an air conditioner, comprising:

a plurality of vertically arranged diaphragms axially spaced apart, each diaphragm having a through hole with a diameter of about 40 to 80 percent of a diameter of the diaphragm, whereby a fluid infused into the fan will form an eddy current; and a central diaphragm vertically disposed in the center of the cross flow fan, the center diaphragm including guide vanes radially disposed about a center of the central diaphragm, each guide vane having a length of about 18 to 50 percent of a diameter of the central diaphragm, wherein the guide vanes forcibly form an eddy current in the fan; and a plurality of horizontally arranged blades mounted between the diaphragms and central diaphragm.

13. The cross flow fan as defined in claim 12 wherein the diameter of the through hole is 78% of the diameter of the diaphragm.

14. The cross flow fan as defined in claim 12 wherein the length of each guide vane is 23 percent of the diameter of the central diaphragm.

15. The cross flow fan as defined in claim 12 wherein each guide vane is shaped as an airfoil.

16. The cross flow fan as defined in claim 12 wherein each guide vane has an incline of about 4.07 percent inclined radially outwardly with respect to a plane of the diaphragm.

17. The cross flow fan as defined in claim 15 wherein each guide vane has an incline of about 4.07 percent inclined radially outwardly with respect to a plane of the diaphragm.

* * * * *

UNITED STATES PATENT AND TRADEMARK OFFICE

CERTIFICATE OF CORRECTION

PATENT NO. : 6,210,114 B1
DATED : April 3, 2001
INVENTOR(S) : Jae-Won Kim

It is certified that error appears in the above-identified patent and that said Letters Patent is hereby corrected as shown below:

Title page,
Item [30], Foreign Application Priority Data, please insert the following information:
-- November 6, 1998 (KR)……...98-47600 --

Signed and Sealed this

Fifth Day of August, 2003

JAMES E. ROGAN
*Director of the United States Patent and Trademark Office*